US012013218B2

(12) United States Patent
LeMarbe

(10) Patent No.: US 12,013,218 B2
(45) Date of Patent: Jun. 18, 2024

(54) BALLISTIC VEST

(71) Applicant: Point Blank Enterprises, Inc., Pompano Beach, FL (US)

(72) Inventor: Randall Jered LeMarbe, Coral Springs, FL (US)

(73) Assignee: Point Blank Enterprises, Inc., Pompano Beach, FL (US)

( * ) Notice: Subject to any disclaimer, the term of this patent is extended or adjusted under 35 U.S.C. 154(b) by 315 days.

(21) Appl. No.: 17/238,331

(22) Filed: Apr. 23, 2021

(65) Prior Publication Data

US 2022/0341712 A1 Oct. 27, 2022

(51) Int. Cl.
*F41H 5/013* (2006.01)
*A41D 13/05* (2006.01)

(52) U.S. Cl.
CPC ..... *F41H 5/013* (2013.01); *A41D 13/05* (2013.01)

(58) Field of Classification Search
CPC ..... A41D 13/05; A41D 13/0518; F41H 1/02; F41H 5/013; A63B 2071/1208
See application file for complete search history.

(56) References Cited

U.S. PATENT DOCUMENTS

| | | | | | |
|---|---|---|---|---|---|
| 2,308,339 | A * | 1/1943 | Mendenhall | A41B 9/06 | 2/113 |
| 3,559,210 | A * | 2/1971 | Hansen | F41H 5/0428 | 2/2.5 |
| 4,610,035 | A * | 9/1986 | Mattila | A41D 13/0518 | 24/453 |
| 5,157,792 | A * | 10/1992 | Allen | F41H 1/02 | 2/92 |
| 5,724,670 | A * | 3/1998 | Price | F41H 5/0485 | 2/2.5 |
| 5,926,842 | A * | 7/1999 | Price | F41H 5/0478 | 2/2.5 |
| 6,026,509 | A * | 2/2000 | Bachner, Jr. | F41H 1/02 | 2/2.5 |
| 6,233,737 | B1 * | 5/2001 | Ditchfield | F41H 1/02 | 2/2.5 |
| 8,578,518 | B1 * | 11/2013 | Pflug | A41B 9/06 | 2/117 |
| 11,035,650 | B2 * | 6/2021 | De Lombaerde | F41H 1/02 | |
| D959,094 | S * | 8/2022 | Tindall | D2/717 | |
| 2019/0170483 | A1 * | 6/2019 | De Lombaerde | F41H 5/0478 | |

* cited by examiner

*Primary Examiner* — Jocelyn Bravo
(74) *Attorney, Agent, or Firm* — Honigman LLP

(57) ABSTRACT

A protective garment includes a shell and an insert. The shell includes a front layer and a rear layer coupled to the front layer. The front layer and the rear layer form a void therebetween. The insert is disposed within the void. The insert includes a main body defining a first lateral side, a second lateral side opposite the first lateral side, and a bottom edge extending between the first lateral side and the second lateral side. The bottom edge defines a recess between the first lateral side and the second lateral side.

11 Claims, 4 Drawing Sheets

BALLISTIC VEST

FIELD

The present disclosure relates generally to a vest, and more particularly to ballistic vest including an anatomical contour.

BACKGROUND

This section provides background information related to the present disclosure and is not necessarily prior art.

Garments, such as vests, often include protective features and are worn to provide body armor to an individual who may be engaged in dangerous activity, such as a law enforcement officer or military personnel. While known garments have proven acceptable for their intended purpose, there remains a continuous need for improvement in the pertinent art. For example, known garments with protective features are frequently bulky, restrict movement of the user, and are difficult to conceal beneath articles of clothing.

SUMMARY

This section provides a general summary of the disclosure, and is not a comprehensive disclosure of its full scope or all of its features.

One aspect of the disclosure provides a garment that includes a shell and an insert. The shell has a front layer and a rear layer coupled to the front layer. The front layer and the rear layer form a void therebetween. The insert is disposed within the shell. The insert includes a main body defining a first lateral side, a second lateral side opposite the first lateral side, and a bottom edge extending between the first lateral side and the second lateral side. The bottom edge defines a recess between the first lateral side and the second lateral side.

Implementations of this aspect of the disclosure may include one or more of the following optional features. In some implementations, at least a portion of the bottom edge is concave. In those examples, the bottom edge may include a first lateral portion, a second lateral portion, and an intermediate portion extending from the first lateral portion to the second lateral portion where the intermediate portion forms a central recess in the bottom edge. Furthermore, the intermediate portion may include a first portion extending from the first lateral portion, a second portion extending from the second lateral portion, and a central portion extending from the first portion to the second portion. In those examples, the first portion may extend from the first lateral portion at a first angle and the second portion extends from the second lateral portion at a second angle equal to the first angle and the central portion, the first portion, and the second portion may define a plateau. In some implementations, the insert includes a first lateral wing and a second lateral wing, the first lateral wing extending in a first direction from the first lateral side and the second lateral wing extending in a second direction opposite the first direction from the second lateral side. In those implementations, the bottom edge defines a recess between the first lateral wing and the second lateral wing. The shell may include a contouring material.

Yet another aspect of the present disclosure provides an insert for a protective garment. The insert includes a main body defining a first lateral side, a second lateral side opposite the first lateral side, and a bottom edge extending between the first lateral side and the second lateral side. The bottom edge includes a first lateral portion, a second lateral portion, and an intermediate portion extending from the first lateral portion to the second lateral portion. The intermediate portion defines a recess between the first lateral side and the second lateral side.

Implementations of this aspect of the disclosure may include one or more of the following optional features. In some implementations, at least a portion of the bottom edge is concave. In those examples, the intermediate portion includes a first portion extending from the first lateral portion, a second portion extending from the second lateral portion, and a central portion extending from the first portion to the second portion. Furthermore, the first portion may extend from the first lateral portion at a first angle and the second portion extends from the second lateral portion at a second angle equal to the first angle. In some examples, the insert includes a first lateral wing extending in a first direction from the first lateral side and a second lateral wing extending in a second direction opposite the first direction from the second lateral side.

Another aspect of the disclosure provides a ballistic vest. The ballistic vest includes a shell and an insert. The shell has a front portion and a rear portion. The front portion has an outer layer and an inner layer forming a void therebetween. The insert is disposed within the void and includes a main body defining a first lateral side, a second lateral side opposite the first lateral side, and a bottom edge extending between the first lateral side and the second lateral side. The bottom edge includes a first lateral portion, a second lateral portion, and an intermediate portion extending from the first lateral portion to the second lateral portion. The intermediate portion defines a recess between the first lateral portion and the second lateral portion. This aspect may include one or more of the following optional features. In some implementations, at least a portion of the bottom edge is concave. Additionally, the intermediate portion may include a first portion extending from the first lateral portion, a second portion extending from the second lateral portion, and a central portion extending from the first portion to the second portion. In those examples, the first portion is disposed relative to the first lateral portion at a first angle and the second portion is disposed relative to the second lateral portion at a second angle equal to the first angle. A first convex junction may extend between the first portion and the first lateral portion and a second convex junction extends between the second portion and the second lateral portion. A first concave junction may extend between the first portion and the central portion and a second concave junction extends between the second portion and the central portion. In some implementations, the insert includes a first lateral wing and a second lateral wing, the first lateral wing extending in a first direction from the first lateral side and the second lateral wing extending in a second direction opposite the first direction from the second lateral side. In some examples, the rear portion of the shell has an outer layer and an inner layer forming a second void therebetween and a second insert is disposed within the second void.

Further areas of applicability will become apparent from the description provided herein. The description and specific examples in this summary are intended for purposes of illustration only and are not intended to limit the scope of the present disclosure.

DRAWINGS

The drawings described herein are for illustrative purposes only of selected configurations and not all possible implementations, and are not intended to limit the scope of the present disclosure.

Corresponding reference numerals indicate corresponding parts throughout the drawings.

DETAILED DESCRIPTION

Example configurations will now be described more fully with reference to the accompanying drawings. Example configurations are provided so that this disclosure will be thorough, and will fully convey the scope of the disclosure to those of ordinary skill in the art. Specific details are set forth such as examples of specific components, devices, and methods, to provide a thorough understanding of configurations of the present disclosure. It will be apparent to those of ordinary skill in the art that specific details need not be employed, that example configurations may be embodied in many different forms, and that the specific details and the example configurations should not be construed to limit the scope of the disclosure.

Figure 1:
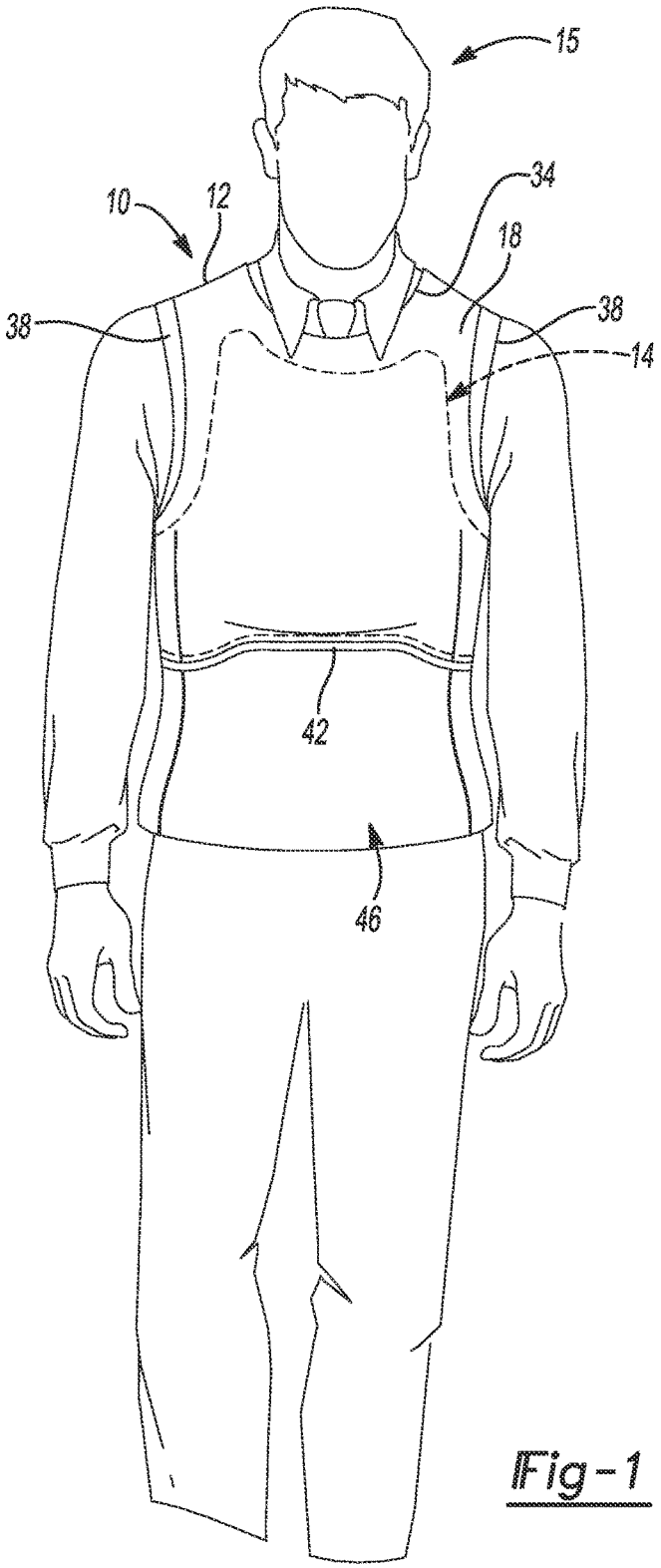
FIG. 1 is a front perspective view of a garment worn by a user in accordance with the principles of the present disclosure.
Figure 2:
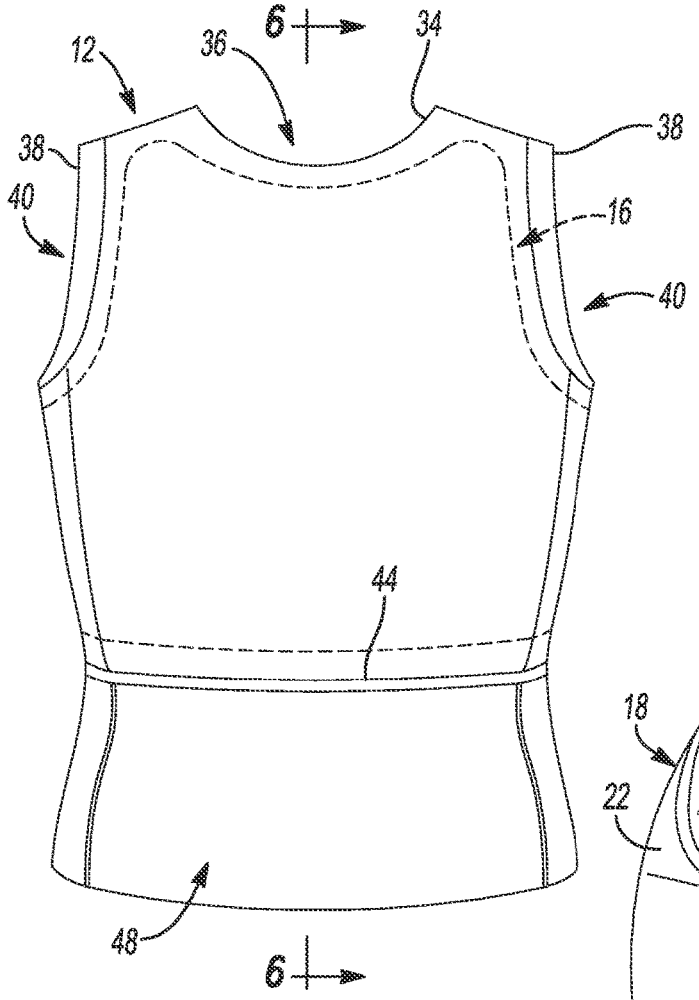
FIG. 2 is a rear elevation view of the garment of FIG. 1.
Figure 3:
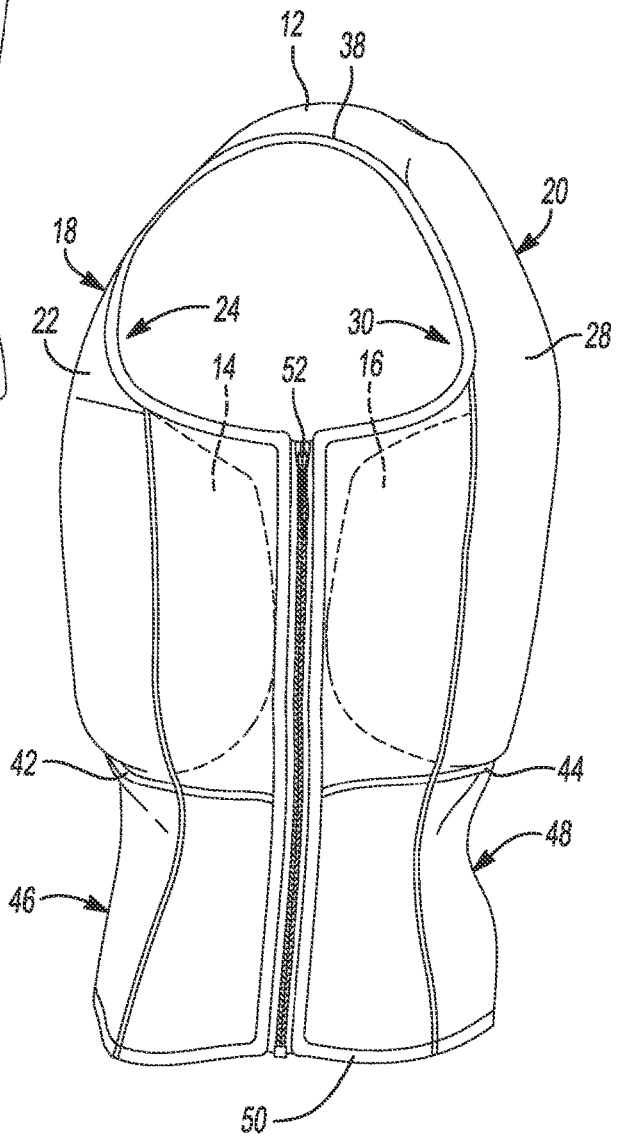
FIG. 3 is a side elevation view of the garment of FIG. 1.

Referring to FIGS. 1-3, a garment 10 is illustrated. While the garment 10 is generally shown and described herein as being a vest, it will be appreciated that the garment 10 may include other articles of apparel within the scope of the present disclosure. For example, the garment may be a sleeved shirt or a bodysuit.

The garment 10 may include a shell 12, a front insert 14, and a rear insert 16. As will be explained in more detail below, in use, the front insert 14 and rear insert 16 may be disposed within the shell 12, and the garment 10 may be worn by a user 15. When worn and with the front 14 and rear inserts 16 disposed within the shell 12, the front 14 and rear inserts 16 substantially cover the front, rear and sides of the torso or thoracic cavity of the user 15 to provide body armor protection over the rib cage and vital organs contained within. The front insert 14 is located at an upper portion of the user's torso and provides coverage to an area that includes the user's chest, clavicle, and mid-section above an area that substantially coincides with the bottom of the ribcage. The rear insert 16 is located at an upper portion of the user's back to provide coverage thereat. The garment 10 may be used as a body armor with the front 14 and rear inserts 16 providing a protective layer from ballistic, penetrating or other forces like bullets, knives, blunt forces and the like.

As shown in the illustrated embodiment of FIG. 1, the garment 10 is worn by a user 15 on the outside of or over articles of clothing. However, it should be understood that the garment 10 may also be worn underneath articles of clothing. The garment 10 is configured to contour to the shape of the user's body. Thus, when the garment 10 is worn underneath articles of clothing, the garment 10 may be concealed from or appear barely noticeable to a third party. The garment 10 may include other features to make wearing the garment less noticeable. For example, the material of the shell 12 and/or the front 14 and rear inserts 16 may be black, white or any suitable color to better conceal the garment 10 beneath exterior articles of clothing. Often a user finds it desirable to hide the fact they are wearing a protective garment or vest, like those described herein, such as when the user is an undercover law enforcement officer and alerting a third party to the presence of a protective garment could endanger their cover.

Referring now to FIGS. 2 and 3, the shell 12 may be formed from a lightweight, breathable fabric, and may include a front portion 18 and a rear portion 20. The front portion 18 may include a front or outer layer 22 and a rear or inner layer 24. The outer layer 22 is coupled to the inner layer 24 to form a front insert pocket 26 (e.g., a void) therebetween. Similarly, the rear portion 20 includes a front or outer layer 28 and a rear or inner layer 30 to form a rear insert pocket 32 (e.g., a void) therebetween.

The front insert pocket 26 has a perimeter defined by a neck collar 34 at a head receiving portion 36 of the shell 12, sleeve collars 38 at each arm receiving portion 40 of the shell, and a front seam 42 across the front portion 18 of the shell. As will be described further below, the front seam 42 may mirror the shape of a bottom edge of the front insert 14 and may be located at a midsection of the shell 12 corresponding to the bottom of the ribcage of the user 15 so as to better contour the garment 10 to the shape of the body of the user.

The rear insert pocket 28 similarly has a perimeter defined by the neck collar 34, sleeve collars 38, and a rear seam 44 across the rear portion 20 of the shell 12. The rear seam 44 may mirror the shape of the bottom edge of the rear insert 16. The front and rear seams 42, 44, respectively, join the outer layers 22, 28 and inner layers 24, 30 of the front and rear portions 18, 20 of the shell 12 and provide support to retain the front and rear inserts 14, 16 in the respective insert pockets 26, 32.

The shell 12 may be formed from a lightweight, breathable and elastic or contouring fabric so that when worn, the material of the shell 12 contours to the shape of the user's body and provides adequate ventilation. This contouring effect helps to conceal the presence of the garment 10, including the inserts 14, 16 when worn beneath an article of clothing. Additionally, the cut of the material of the shell 12 enables a full range of motion for the user 15 and prevents unnatural shifting of the garment 10 beneath an article of clothing during use. For example, the shape of the arm-receiving portions 40 of the shell allow a user to lift their arms fully above their head without pulling or shifting the garment 10 upwards on their body.

The elasticity of the material of the shell 12 also helps to retain the front and rear inserts 14, 16 in place at the front and rear insert pockets 26, 32, respectively. The outer layers 22, 28 and inner layers 24, 30 may be made from the same or differing materials. For example, the inner layer 24, 30 may be formed at least in part from an antimicrobial, sweat-wicking material for added user comfort, while the outer layer 22, 28 may be formed at least in part from a stretch, mesh material to accommodate frequent insertion and removal of the inserts 14, 16 and provide added ventilation.

The outer layers 22, 28 and inner layers 24, 30 of the front portion 18 may join or otherwise transition to a single layer of material beneath the front seam 42 (e.g., FIG. 6), defining a front tail portion 46 of the shell 12. Similarly, the outer layers 22, 28 and inner layers 24, 30 of the rear portion 20 may join or otherwise transition to a single layer of material beneath the rear seam 44, defining a rear tail portion 48 of the shell 12. While the front and rear tail portions 46, 48 are generally shown and described herein as being separate layers of material relative to the outer layers 22, 28 and inner layers 24, 30, it will be appreciated that the front tail portion 46 may be integrally and/or monolithically formed with the outer and inner layers 22, 24, and the rear tail portion 48 may be integrally and/or monolithically formed with the outer and inner layers 28, 30. When the garment 10 is worn, the front and rear tail portions 46, 48 contour to the abdomen and lower back, respectively, of the user 15 so as to further reduce the profile of the garment 10 on the user.

The neck collar 34 and sleeve collars 38 may be made at least in part of an elastic material to contour the edges of the shell 12 to the body of the user 15 and reduce the possibility of an edge of the garment 10 showing through an exterior article of clothing. The elastic material of the compression neck collar 34 and compression sleeve collars 38 also help maintain the position of the garment 10 on the body of the user to prevent shifting of the garment 10 during use, which could restrict movement of the user or make wearing of the garment more noticeable. Similar elastic material may be included at a bottom edge of the shell 12 to provide a tail collar 50 or in other suitable locations to provide desired contouring. Alternatively, the neck collar 34, sleeve collars 38, and/or tail collars 50 may be seamless edges of the material of the garment 10.

Fastening elements may be included at one or both side portions (FIG. 3) of the shell 12 to join the front and rear portions 18, 20. As shown, a zipper 52 extends along the side of the shell 12 from the tail collar 50 to the sleeve collar 38. The elastic material of the sleeve collars 38 may extend along both sides of the zipper 52 to provide elasticity at the fastening element. Fastening elements may be included on one or both sides of the shell 12 to aid in easier and quicker placement of the garment 10 on the user 15. For example, the user may place their head through the head receiving portion 36 of the garment 10 and their arms through the arm receiving portions 40 of the garment 10 with one or both of the side zippers 50 unfastened. At this point, the garment 10 would hang loosely at the user's body. Then, the user fastens the zipper 50 (as shown in FIG. 3) to join the front 18 and rear portions 20 of the garment 10 and contour the elastic material of the shell 12 to their body.

It should be understood that the fastening element joining the front and rear portions 18, 20 of the garment 10 may be any suitable fastening device, such as cord and shrink tube pulls, snap buttons, hook and loop connections, or side-release buckles. Separating the front and rear portions 18, 20 of the garment, 10 such as via a fastening element, may also provide access for inserting and removing the front and rear inserts 14, 16 from the front and rear insert pockets 26, 32.

Figure 4:
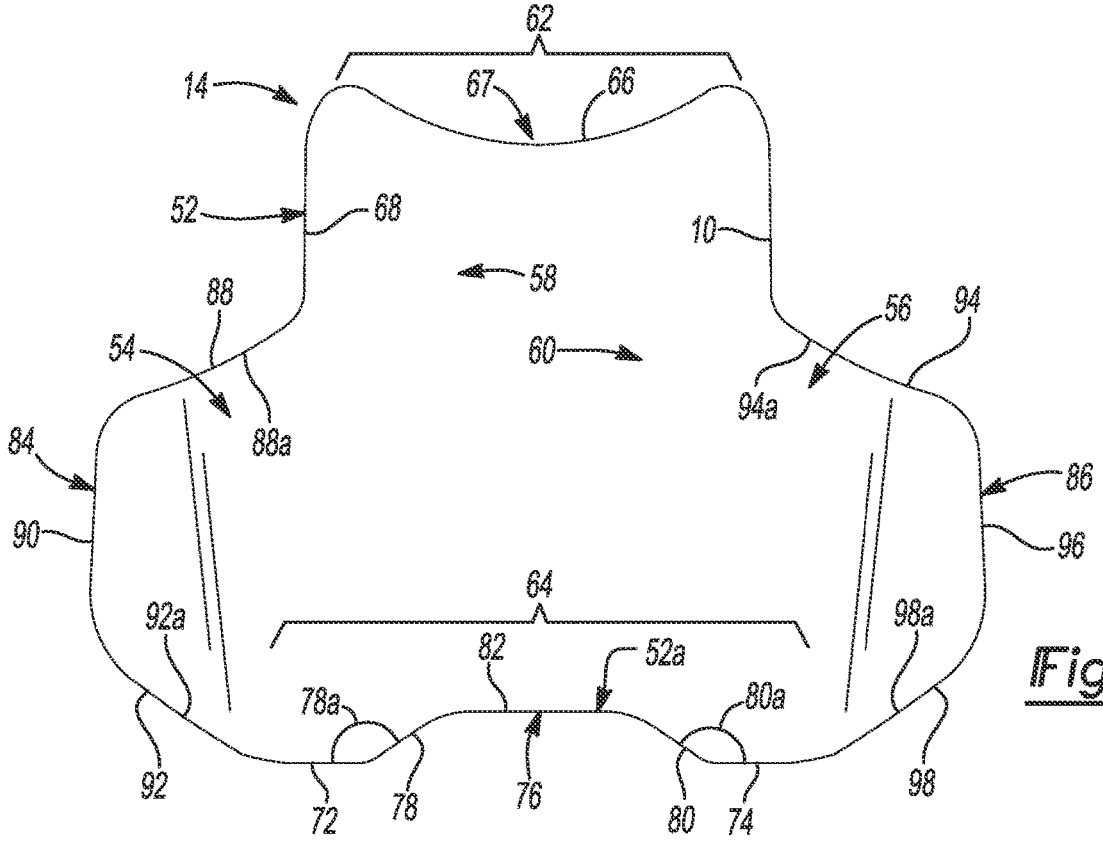
FIG. 4 is a front view of a front insert of the garment of FIG. 1.

Referring now to FIG. 4, the front insert 14 is configured to cover the front thoracic cavity of the user 15 when the garment 10 is worn by the user. The front insert 14 may include a main body 52, a first lateral wing 54 and a second lateral wing 56. The main body 52 may include a first lateral side 58 and a second lateral side 60 opposite the first lateral side, and may extend between a collar or top edge 62 and a bottom edge 64. The top and bottom edges 62, 64 may extend between the first and second lateral sides 58, 60. The top edge 62 may form an arcuate (e.g., concave) collar 66 defining a recess 67 in the main body 52. The recess 67 can receive the front of the neck of the user 15 when the front insert 14 is disposed in the front insert pocket 26 of the shell 12 and the garment 10 is worn by the user.

The first lateral side 58 of the main body 52 defines a first main-body edge 68 of the front insert 14 that extends from the top edge 62 to the first lateral wing 54. Similarly, the second lateral side 60 of the main body 52 defines a second main-body edge 70 of the front insert 14 that extends from the top edge 62 to the second lateral wing 56. Thus, the main body 52 extends vertically between the top 62 and bottom edges 64 of the front insert 14 and horizontally from the first lateral wing 54 and/or first main-body edge 68 to the second lateral wing 56 and/or second main-body edge 70. The main body 52 is configured to cover and provide protection to the front thoracic cavity of the user including the upper clavicle region, chest and lower rib cage, with the bottom edge 64 of the front insert 14 configured to simulate or mimic the shape of the bottom of the rib cage to accommodate the user's range of motion and contour the garment 10 and insert to the shape of the user's body.

The bottom edge 64 defines a recess 52*a* in the main body 52 between the first lateral side 58 and the second lateral side 60 and is configured to trace or match the outline of the bottom of the ribcage to simulate or mimic the shape of the user's body. In some implementations, the bottom edge 64 includes a first lateral portion 72, a second lateral portion 74, and an intermediate portion 76 extending between the first and second lateral portions and defining the recess 52*a* in the main body 52 at the bottom edge 64. Thus, the intermediary portion 76 may substantially align with the bottom end of the sternum of the user, and the first 72 and second lateral portions 74 of the bottom edge 64 may align with the bottom edge of the ribcage. The intermediary portion 76 or recessed edge may include a first portion 78 extending from the first lateral portion 72 of the bottom edge, a second portion 80 extending from the second lateral portion 74 of the bottom edge, and a central portion 82 extending between the first 78 and second portions 78 of the intermediate portion 76. The first portion 78 may extend from the first lateral portion 72 at a first angle 78*a* upward into the main body 52, and the second portion 80 may extend from the second lateral portion 74 at a second angle 80*a*. The second angle 80*a* may be equal to the first angle 78*a*. The first and second angles 78*a*, 80*a* may be between 90 degrees and 175 degrees. In some implementations, the first and second angles 78*a*, 80*a* are substantially equal to 135 degrees. The central portion 82 together with the first 78 and second portions 80, may form a plateau of the bottom edge 64. Thus, the bottom edge 64 may substantially trace the outline of a user's ribcage.

The junction between the first lateral portion 72 and the first portion 78 of the intermediate portion 76 and the junction between the second lateral portion 74 and the second portion 80 of the intermediate portion 76 may define a convex curvature. The junction between the first portion 78 of the intermediate portion 76 and the central portion 82 of the intermediate portion 76 and the junction between the second portion 80 of the intermediate portion 76 and the central portion 82 of the intermediate portion 76 may define a concave curvature. In some implementations, an entirety of the first portion 78, the second portion 80, and/or the central portion 82 may extend arcuately (e.g., concave) between the first lateral portion 72 and the second lateral portion 74. The curvature of the portions 78, 80, and/or 82 and/or the junctions increase user comfort and help to conceal the edges of the front insert 14 when the garment 10 is worn by a user. Thus, the material of the shell 12 may fall in a naturally tapered fashion from the edges of the front insert 14 rather than creating a noticeable hard crease underneath the user's article of clothing.

The first lateral wing 54 extends from the first lateral side 58 in a first direction and the second lateral wing 56 extends in a second direction opposite the first direction from the second lateral side 60. When the front insert 14 is disposed in the front insert pocket 26 and the garment 10 is worn by the user, the first and second lateral wings 54, 56 are configured to cover the sides of the thoracic cavity of the user's body under the user's arms and above the bottom of the user's ribcage. As outlined above, the first lateral wing 54 defines a first wing-side edge 84 of the front insert 14 and the second lateral wing 56 defines a second wing-side edge 86 of the front insert 14. The first wing-side edge 84 may extend from the bottom edge 64 to the first main-body edge 68, and the second wing-side edge 86 may extend from the bottom edge 64 to the second main-body edge 70.

The first wing-side edge 84 includes a first wing-side upper portion 88, an intermediary portion 90, and a lower portion 92. Similarly, the second wing-side edge 86 includes a second wing-side upper portion 94, an intermediary portion 96, and a lower portion 98. The upper portions 88, 94 may extend respectively from the main-body edges 68, 70. The lower portions 92, 98 may extend respectively from the bottom edge 64. The intermediary portions 90, 96 may extend respectively between the upper 88, 94 and lower portions 92, 98.

The upper portions 88, 94 may meet the main-body edges 68, 70 at concave junctions, establishing obtuse angular relationships between the main-body edges 68, 70 and the lengths 88*a*, 94*a* of the upper portions 88, 94 of the wing-side edges 84, 86. The lower portions 92, 98 may meet the bottom edge 64 at convex junctions, establishing obtuse angular relationships between the bottom edge 64 and the lengths 92*a*, 98*a* of the lower portions 92, 98 of the wing-side edges 84, 86. The intermediary portions 90, 96 may meet the upper 88, 94 and lower portions 92, 98 at concave junctions and establish linear connections between the upper 88, 94 and lower portions 92, 98. The junctions between the upper 88, 94, intermediary 90, 96, lower portions 92, 98 and the main-body edges 68, 70 and bottom edge 64 are curved in nature to increase user comfort and provide a smooth edge less likely to create obvious creases beneath articles of clothing. Additionally, the angle with which the junctions of the lateral wings 54, 56 meet the main body 52, establish a taper to enable a natural, unrestricted range of motion for the user. Thus the lateral wings 54, 56 can provide protection at front of the user's sides without restricting side bending or arm movements.

Although described herein as including first and second lateral wings 54, 56, it should be understood that the insert 14 may include only the main body portion 52 so that, when the insert is disposed in the shell, the insert provides coverage mainly to the front thoracic region of the user and does not include lateral wings providing coverage at the user's sides. In such a manner, the garment may provide an even more low profile, concealable, and/or less restrictive protective garment that substantially contours to the user's body with a bottom edge configured to mimic the outline of a user's ribcage without providing the added bulk or noticeable protrusion of the lateral wings at the user's sides.

Figure 5:
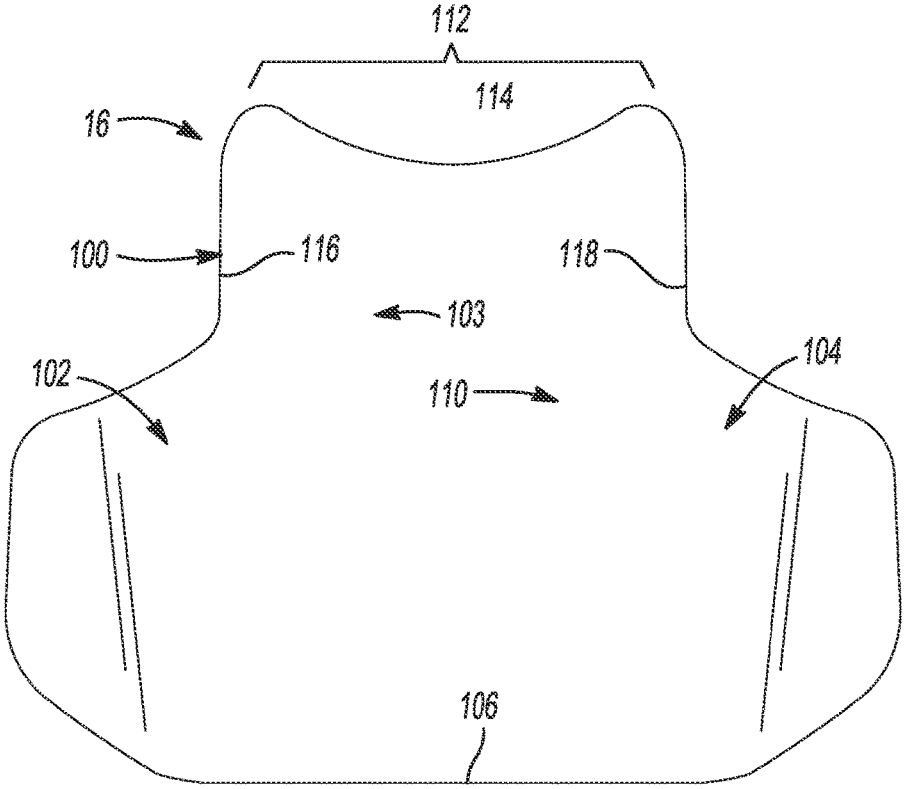
FIG. 5 is a front view of a rear insert of the garment of FIG. 1.

Now turning to FIG. 5, the rear insert 16 is configured to cover the rear thoracic cavity of a user when the garment 10 is worn by the user. The rear insert 16 is substantially similar to the front insert 14 and includes a main body 100, a first lateral wing 102 and a second lateral wing 104. Because the rear insert 16 is substantially similar to the front insert 14, a full discussion of the rear insert 16 may be omitted in the interest of clarity and only an abbreviated description is contained herein to highlight some features of the rear insert 16. For example, one particular difference between the front and rear inserts 14, 16 is that the bottom edge 106 of the rear insert 16 may extend linearly from the first lateral wing 102 to the second lateral wing 104.

The main body 100 may include a first lateral side 108 and a second lateral side 110 opposite the first lateral side 108. The main body 100 extends between a collar or top edge 112 and the bottom edge 106. The top and bottom edges 112, 106 may extend between the first and second lateral sides 108, 110. The top edge 112 defines an arched collar 114 or concave recess in the main body 100 configured to accommodate the rear of the neck of the user 15. The top edge 112 of the rear insert 16 may define a concave recess 114 having a greater radius of curvature than the concave recess 66 defined by the top edge 62 of the front insert 14 as the rear insert 16 need not accommodate as much of the user's neck.

The first lateral side 108 of the main body 100 defines a first main-body edge 116 of the rear insert 16 that extends from the top edge 112 to the first lateral wing 102. Similarly, the second lateral side 110 of the main body 100 defines a second main-body edge 118 of the rear insert 16 that extends from the top edge 112 to the second lateral wing 104. Thus, the main body 100 extends vertically between the top 112 and bottom edges 106 of the rear insert 16 and horizontally from the first lateral wing 102 and/or first main-body edge 116 to the second lateral wing 104 and/or second main-body edge 118. The main body 100 is configured to cover and provide protection to the rear of the user's thoracic cavity including the upper back and extending to the bottom of the rear of the ribcage while the first and second lateral wings are configured to contour to the sides of the user and provide protection at the rear sides.

In an assembled configuration (e.g., FIGS. 1-3 and 6), the front 14 and rear inserts 16 are disposed within the front 26 and rear insert pockets 32, respectively, of the shell 12 to substantially cover the thoracic cavity of the user. The inserts 14, 16 are made from any suitably flexible and durable ballistic material. When worn, the elastic or contouring material of the shell 12 provides resistance at the outer-facing surfaces 14*a*, 16*a* of the inserts 14, 16 to contour the user-facing surfaces 14*b*, 16*b* of the inserts to the body of the user. The first and second lateral wings of the inserts 14, 16 may be flexible relative to the main body 52, 100, respectively, and wrap around the sides of the user. The garment 10, such as via the shape of the front and rear inserts 14, 16, contouring material of the shell 12, and configuration of the arm-receiving portions, allows a full range of motion of the user 15 wearing the garment while ensuring a discrete and protective fit.

Figure 6:
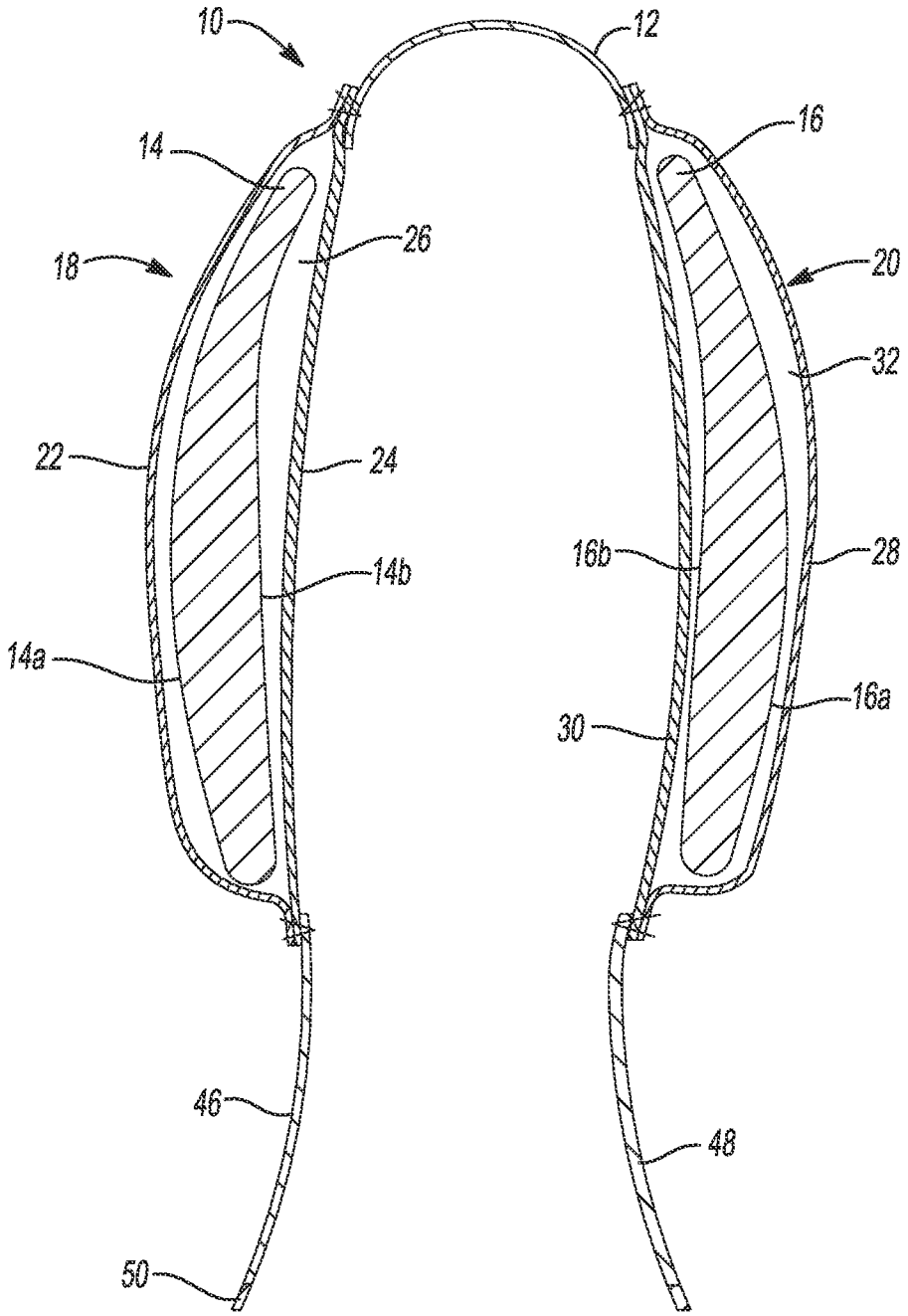
FIG. 6 is a cross-sectional view of the garment of FIG. 1 taken along the line 6-6 of FIG. 2.

In reference to FIG. 6, a cross-sectional view of the garment 10 taken along a midline shows how the front 14 and rear inserts 16 are contained within the front 26 and rear insert pockets 32. In use, the outer layers 22, 28 and inner layers 24, 30 of the insert pockets 26, 32 may engage the surface(s) of the front and rear inserts 14, 16. As shown, the thickness of the inserts 14, 16 may vary in desired locations such as to provide added padding or protection to more vulnerable parts of the user's body or to better simulate or contour the shape of the garment to the user's body. Additionally, the outer-facing surfaces 14*a*, 16*a* of the front and rear inserts 14, 16 may be configured to better simulate the shape of the user's body. For example, the surfaces 14*a*, 16*a* and thicknesses may be different for users of different body sizes and shapes. An embodiment may be configured to contour and/or simulate to the shapes of heavier, lighter, taller, shorter, male and female users. The inserts 14, 16 may even be specifically designed or created from a mold to mimic the individual user's body shape or any desired body shape. The thickness of the inserts 14, 16 near the edges (such as the top or bottom edges) may be tapered to provide a natural look and increase comfort of the garment against the user's body. For example, a tapered thickness beginning at the top edge (near the user's collar) may give the impression that the garment worn beneath articles of clothing is just the user's natural body weight.

Thus, the present disclosure provides a garment that includes a shell having an inner layer and an outer layer forming a void or pocket therebetween. An insert disposed between the inner and outer layers of the shell has a main body and first and second lateral wings. The main body defines a first lateral side, a second lateral side opposite the first lateral side, and a bottom edge extending between the first lateral side and the second lateral side. The first lateral wing extends in a first direction from the first lateral side and the second lateral wing extends in a second direction opposite the first direction from the second lateral side. The bottom edge defines a recess between the first lateral wing and the second lateral wing. The garment is configured to contour to the shape of a user's body and the bottom edge of the insert is configured to simulate or follow the bottom of the user's ribcage to enable full range of motion of the user and provide discrete protection for the user wearing the garment.

The terminology used herein is for the purpose of describing particular exemplary configurations only and is not intended to be limiting. As used herein, the singular articles "a," "an," and "the" may be intended to include the plural forms as well, unless the context clearly indicates otherwise. The terms "comprises," "comprising," "including," and "having," are inclusive and therefore specify the presence of features, steps, operations, elements, and/or components, but do not preclude the presence or addition of one or more other features, steps, operations, elements, components, and/or groups thereof. The method steps, processes, and operations described herein are not to be construed as necessarily requiring their performance in the particular order discussed or illustrated, unless specifically identified as an order of performance. Additional or alternative steps may be employed.

When an element or layer is referred to as being "on," "engaged to," "connected to," "attached to," or "coupled to" another element or layer, it may be directly on, engaged, connected, attached, or coupled to the other element or layer, or intervening elements or layers may be present. In contrast, when an element is referred to as being "directly on," "directly engaged to," "directly connected to," "directly attached to," or "directly coupled to" another element or layer, there may be no intervening elements or layers present. Other words used to describe the relationship between elements should be interpreted in a like fashion (e.g., "between" versus "directly between," "adjacent" versus "directly adjacent," etc.). As used herein, the term "and/or" includes any and all combinations of one or more of the associated listed items.

The terms first, second, third, etc. may be used herein to describe various elements, components, regions, layers and/or sections. These elements, components, regions, layers and/or sections should not be limited by these terms. These terms may be only used to distinguish one element, component, region, layer or section from another region, layer or section. Terms such as "first," "second," and other numerical terms do not imply a sequence or order unless clearly indicated by the context. Thus, a first element, component, region, layer or section discussed below could be termed a second element, component, region, layer or section without departing from the teachings of the example configurations.

Clause 1: A protective garment including a shell including a front layer and a rear layer coupled to the front layer, the front layer and the rear layer forming a void therebetween, and an insert disposed within the void, the insert including a main body defining a first lateral side, a second lateral side opposite the first lateral side, and a bottom edge extending between the first lateral side and the second lateral side, the bottom edge defining a recess between the first lateral side and the second lateral side.

Clause 2: The protective garment of Clause 1, wherein at least a portion of the bottom edge is concave and includes a first lateral portion, a second lateral portion, and an intermediate portion extending from the first lateral portion to the second lateral portion, and wherein the intermediate portion forms a central recess in the bottom edge.

Clause 3: The protective garment of Clause 2, wherein the intermediate portion includes a first portion extending from the first lateral portion, a second portion extending from the second lateral portion, and a central portion extending from the first portion to the second portion.

Clause 4: The protective garment of Clause 3, wherein the first portion extends from the first lateral portion at a first angle, and the second portion extends from the second lateral portion at a second angle equal to the first angle.

Clause 5: The protective garment of Clause 4, wherein the central portion, the first portion, and the second portion define a plateau.

Clause 6: The protective garment of Clause 4, wherein at least one of the central portion, the first portion, and the second portion is concave.

Clause 7: The protective garment of Clause 1, wherein the insert further includes a first lateral wing and a second lateral wing, the first lateral wing extending in a first direction from the first lateral side and the second lateral wing extending in a second direction opposite the first direction from the second lateral side, the bottom edge defining a recess between the first lateral wing and the second lateral wing.

Clause 8: The protective garment of Clause 1, wherein the shell comprises a contouring material.

Clause 9: An insert for a protective garment, the insert including a main body defining a first lateral side, a second lateral side opposite the first lateral side, and a bottom edge extending between the first lateral side and the second lateral side, the bottom edge including a first lateral portion, a second lateral portion, and an intermediate portion extending from the first lateral portion to the second lateral portion, the intermediate portion defining a recess between the first lateral side and the second lateral side.

Clause 10: The insert of Clause 9, wherein at least a portion of the intermediate portion of the bottom edge is concave and includes a first portion extending from the first lateral portion, a second portion extending from the second lateral portion, and a central portion extending from the first portion to the second portion.

Clause 11: The insert of Clause 10, wherein the first portion extends from the first lateral portion at a first angle, and the second portion extends from the second lateral portion at a second angle equal to the first angle.

Clause 12: The insert of Clause 11, wherein at least one of the central portion, the first portion, and the second portion is concave.

Clause 13: The insert of Clause 9, wherein the insert comprises a first lateral wing extending in a first direction from the first lateral side and a second lateral wing extending in a second direction opposite the first direction from the second lateral side.

Clause 14: A ballistic vest, the vest including a shell including a front portion and a rear portion, the front portion including an outer layer and an inner layer forming a void therebetween, and an insert disposed within the void, the insert including a main body defining a first lateral side, a second lateral side opposite the first lateral side, and a bottom edge extending between the first lateral side and the second lateral side, the bottom edge including a first lateral portion, a second lateral portion, and an intermediate portion extending from the first lateral portion to the second lateral portion, the intermediate portion defining a recess between the first lateral portion and the second lateral portion.

Clause 15: The ballistic vest of Clause 14, wherein at least a portion of the bottom edge is concave and includes a first portion extending from the first lateral portion, a second portion extending from the second lateral portion, and a central portion extending from the first portion to the second portion.

Clause 16: The ballistic vest of Clause 15, wherein the first portion is disposed relative to the first lateral portion at a first angle, and the second portion is disposed relative to the second lateral portion at a second angle equal to the first angle.

Clause 17: The ballistic vest of Clause 16, wherein a first convex junction extends between the first portion and the first lateral portion, and a second convex junction extends between the second portion and the second lateral portion.

Clause 18: The ballistic vest of Clause 17, wherein a first concave junction extends between the first portion and the central portion, and a second concave junction extends between the second portion and the central portion.

Clause 19: The ballistic vest of Clause 14, wherein the rear portion of the shell has an outer layer and an inner layer forming a second void therebetween, and wherein a second insert is disposed within the second void.

Clause 20: The ballistic vest of Clause 14, wherein the insert includes a first lateral wing and a second lateral wing, the first lateral wing extending in a first direction from the first lateral side and the second lateral wing extending in a second direction opposite the first direction from the second lateral side.

The foregoing description has been provided for purposes of illustration and description. It is not intended to be exhaustive or to limit the disclosure. Individual elements or features of a particular configuration are generally not limited to that particular configuration, but, where applicable, are interchangeable and can be used in a selected configuration, even if not specifically shown or described. The same may also be varied in many ways. Such variations are not to be regarded as a departure from the disclosure, and all such modifications are intended to be included within the scope of the disclosure.

What is claimed is:

1. A protective garment comprising:

a shell including a front layer and a rear layer coupled to the front layer, the front layer and the rear layer forming a void therebetween; and an insert disposed within the void, the insert including a main body defining a first lateral side, a second lateral side opposite the first lateral side, a first lateral wing extending from the first lateral side, a second lateral wing extending from the second lateral side, and a bottom edge extending between the first lateral side and the second lateral side, the bottom edge including a first lateral portion extending from the first lateral side, a second lateral portion extending from the second lateral side, an intermediate portion defining a recess having a first edge portion extending at a first angle relative to the first lateral portion of the bottom edge, a second edge portion extending at a second angle relative to the second lateral portion of the bottom edge, and a straight central edge portion extending between the first edge portion and the second edge portion.

2. The protective garment of claim 1, wherein at least a portion of the bottom edge is concave and the intermediate portion extends from the first lateral portion to the second lateral portion.

3. The protective garment of claim 2, wherein the first edge portion extends from the first lateral portion at the first angle, and the second edge portion extends from the second lateral portion at the second angle, wherein the second angle is equal to the first angle.

4. The protective garment of claim 3, wherein an intersection between the intermediate portion and at least one of the first edge portion or the second edge portion is concave.

5. The protective garment of claim 1, wherein the shell comprises a contouring material.

6. A ballistic vest, the vest comprising:

a shell including a front portion and a rear portion, the front portion including an outer layer and an inner layer forming a void therebetween; and an insert disposed within the void, the insert including a main body defining a first lateral side, a second lateral side opposite the first lateral side, and a bottom edge extending between the first lateral side and the second lateral side, the bottom edge including a first lateral portion, a second lateral portion, and an intermediate portion extending from the first lateral portion to the second lateral portion, the intermediate portion defining a recess between the first lateral portion and the second lateral portion, the recess having a first edge portion extending at a first angle relative to the first lateral portion of the bottom edge, a second edge portion extending at a second angle relative to the second lateral portion of the bottom edge, and a straight central edge portion extending between the first edge portion and the second edge portion.

7. The ballistic vest of claim 6, wherein the first edge portion is disposed relative to the first lateral portion at a first angle, and the second edge portion is disposed relative to the second lateral portion at a second angle equal to the first angle.

8. The ballistic vest of claim 7, wherein a first convex junction extends between the first edge portion and the first lateral portion, and a second convex junction extends between the second edge portion and the second lateral portion.

9. The ballistic vest of claim 8, wherein a first concave junction extends between the first edge portion and the straight central edge portion, and a second concave junction extends between the second edge portion and the straight central edge portion.

10. The ballistic vest of claim 6, wherein the rear portion of the shell has an outer layer and an inner layer forming a second void therebetween, and wherein a second insert is disposed within the second void.

11. The ballistic vest of claim 6, wherein the insert includes a first lateral wing and a second lateral wing, the first lateral wing extending in a first direction from the first lateral side and the second lateral wing extending in a second direction opposite the first direction from the second lateral side.

* * * * *